US007131869B2

(12) United States Patent
Fukatsu

(10) Patent No.: US 7,131,869 B2
(45) Date of Patent: Nov. 7, 2006

(54) CONNECTOR AND RESIN MOLDING METHOD THEREFOR

(75) Inventor: Yukihiro Fukatsu, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/972,724

(22) Filed: Oct. 25, 2004

(65) Prior Publication Data

US 2005/0095909 A1 May 5, 2005

(30) Foreign Application Priority Data

Oct. 30, 2003 (JP) ..... 2003-371050

(51) Int. Cl.
*H01R 13/40* (2006.01)

(52) U.S. Cl. ..... 439/595

(58) Field of Classification Search ..... 439/595, 439/752, 744

See application file for complete search history.

(56) References Cited

U.S. PATENT DOCUMENTS 6,338,654 B1 * 1/2002 Sasaki et al. ..... 439/595
6,817,900 B1 * 11/2004 Yamawaki et al. ..... 439/595
6,843,677 B1 * 1/2005 Fukuda ..... 439/374

FOREIGN PATENT DOCUMENTS

JP 6-325814 11/1994

* cited by examiner

*Primary Examiner*—Alexander Gilman
(74) *Attorney, Agent, or Firm*—Gerald E. Hespos; Anthony J. Casella

(57) ABSTRACT

A male housing (20) has cavities (23) into which male terminal fittings (10) are insertable and locks (24) for locking the male terminal fittings (10) in the cavities (23). Each lock (24) is deformed temporarily resiliently during insertion of the male terminal fitting (10), and is restored resiliently to lock the male terminal fitting (10) when the male terminal fitting (10) reaches a proper depth. Lowered parts (35) of bottom walls (34) of the cavities (23) facing the locks (24) with deformation spaces (S) therebetween are provided at their portions coupled to the locks (24) with bulges (49) bulging toward the locks (24). Each bulge (49) is inclined such that a bulging distance thereof gradually increases toward the corresponding lock (24).

8 Claims, 10 Drawing Sheets

CONNECTOR AND RESIN MOLDING METHOD THEREFOR

BACKGROUND OF THE INVENTION

1. Field of the Invention

The invention relates to a connector with a lock and to a resin molding method therefor.

2. Description of the Related Art

Japanese Unexamined Patent Publication No. H06-325814 and FIG. 10 herein disclose a connector with a lock for locking a terminal fitting. With reference to FIG. 10 the connector has terminal fittings 1 that are locked in cavities 2 in a housing 4. The housing 4 is formed with locks 3 for locking the terminal fittings 1 inserted into the cavities 2. The locks 3 are deformed into deformation spaces and towards walls 6 of the cavity 2 in the process of inserting the terminal fittings 1. The locks 3 then are restored resiliently when the terminal fittings 1 reach a proper depth to lock the terminal fittings 1.

The housing 4 is molded by filling a molten resin into a forming mold. The forming mold then is opened when the resin is solidified. The connector can be miniaturized by thinning the walls 6 of the housing 4 that face the locks 3. However, it becomes more difficult for the molten resin to flow into couplings between the walls 6 and the base ends of the locks 3, thereby creating a potential for molding error. Thicker walls 6 improve the flow of resin, but lead to a larger connector. This problem could not be easily solved.

The invention was developed in view of the above problem and an object thereof is to avoid molding errors without enlarging a connector.

SUMMARY OF THE INVENTION

The invention relates to a connector with a resin housing. The housing has at least one cavity into which a terminal fitting is insertable. The housing also has at least one lock for locking the terminal fitting in the cavity. The lock is deformed temporarily into a deformation space and towards a wall of the housing in the process of inserting the terminal fitting. The lock resiliently restores to lock the terminal fitting when the terminal fitting reaches a proper depth. The wall of the housing that faces the lock has a bulge that deforms towards the lock at a location near the base end of the lock.

The housing is formed by filling a molten resin into a mold. The bulge in the wall near the base end of the lock enables the resin to flow easily into portions of the mold where the locks and the facing walls are to be formed. Thus, molding errors are less likely. Further, the bulge is in a dead space between the lock and the facing wall, and does not enlarge the connector.

The bulge preferably bulges to a position at or near a position reached by a surface of the lock substantially facing the deformation space when the lock is deformed maximally. Thus, the bulge uses a maximum amount of the dead space and enables the resin to flow even more easily.

The bulge preferably is inclined so that a bulging distance thereof gradually increases toward the base end of the lock. The molten resin can flow more easily flow as compared to a case where the bulge has a stepped shape.

The bulge preferably is inclined so that the bulging distance thereof takes its maximum value at or near the coupled portion to the lock.

The wall with the bulge preferably comprises a recess substantially facing the lock from a deformation direction with the deformation space therebetween. The recess is engageable with a surface of the lock before the lock is deformed beyond its resiliency limit.

The lock preferably has a base that is wider than a projection thereof. The base preferably is at least as wide as cavity, and/or the projection preferably is slightly narrower than the cavity.

Grooves are formed in opposite sidewalls of the cavity to form the lock. Each groove has open front and rear ends.

Opposite sides of the bulge preferably bulge out into the grooves to be coupled at least partly to the opposite side walls of the cavity.

The bulge preferably is wider than a base portion of the lock.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A connector according to the invention is described with reference to FIGS. 1 to 9. The connector has a male housing 20 and male terminal fittings 10 are accommodated in the male housing 20. In the following description, the inserting and withdrawing directions IWD of the male terminal fittings 10 into the male housing 20 are referred to as forward and backward directions, respectively. Additionally, reference is made to the drawings, except FIG. 1, concerning the vertical direction. However, the terms vertical, up, down, top and bottom are used as a convenient frame of reference and are not intended to imply a required gravitational orientation.

Figure 1:
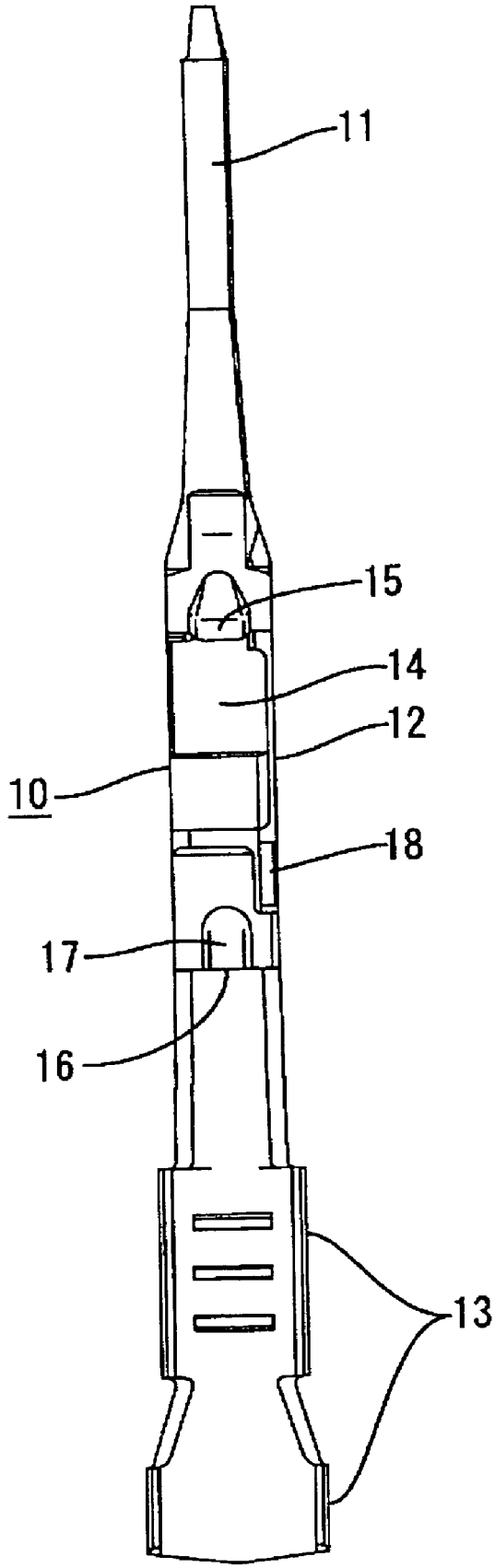
FIG. 1 is a bottom view of a male terminal fitting according to one embodiment of the invention.
Figure 4:
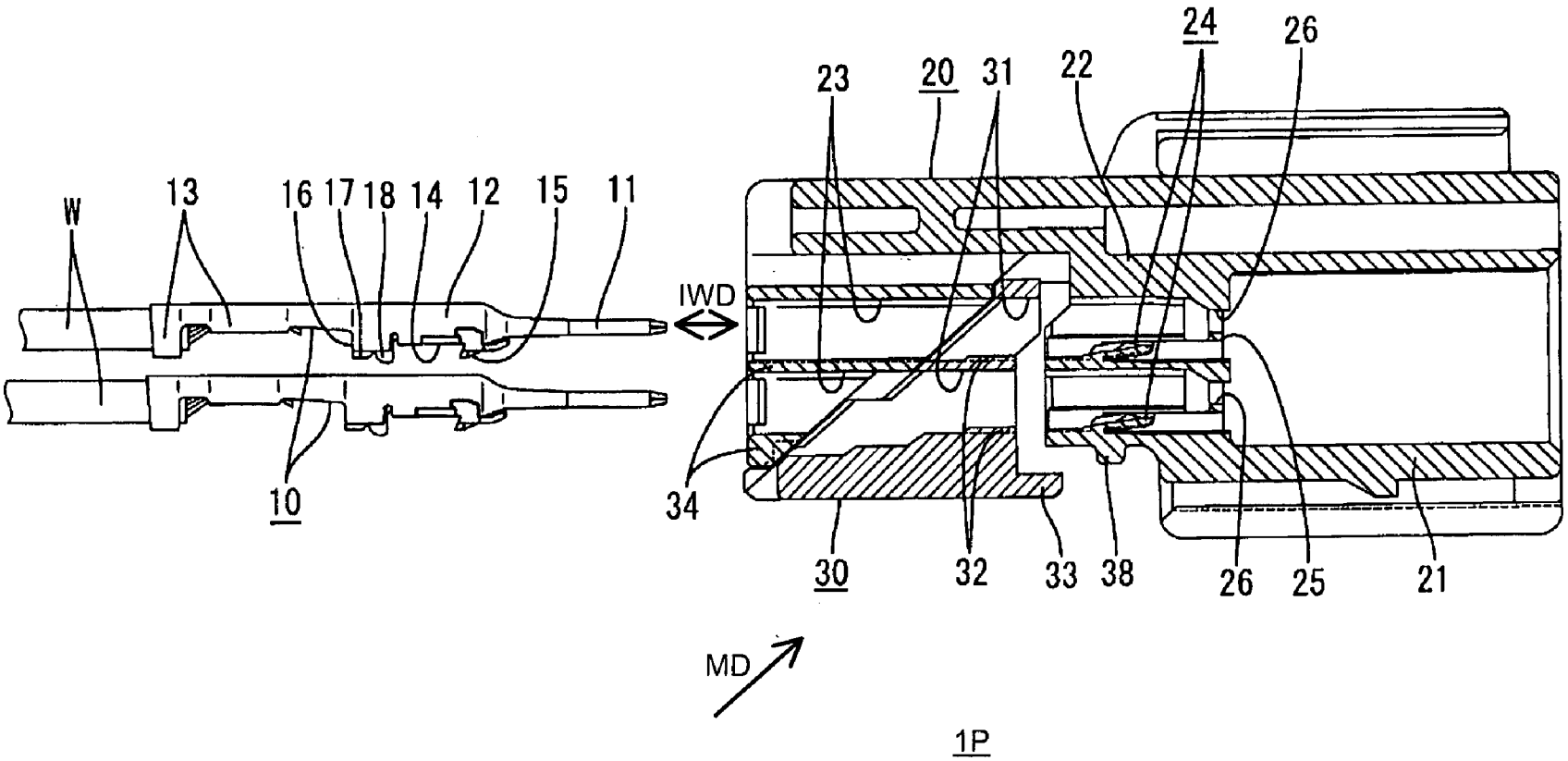
FIG. 4 is a section along 4—4 of FIG. 2 showing a state before the male terminal fittings are inserted into the male housing.

The male terminal fitting 10 is formed by bending, folding and/or embossing a metal plate stamped or cut out into a specified development or shape. The male terminal fitting 10 includes a tab 11, a substantially box-shaped main portion 12 and a barrel 13 in this order from the front, as shown in FIGS. 1 and 4. The tab 11 is electrically connectable with a mating female terminal fitting (not shown). More particularly, the tab 11 is formed by folding a plate that extends from the front edge of the main portion 12. The plate is folded along the longitudinal direction to bring two sections into close contact. As a result, the tab 11 is long and narrow along forward and backward directions. The barrel 13 has two front crimping pieces and two rear crimping pieces. The front crimping pieces are crimped, bent or folded into connection with a core of a wire W and the rear crimping pieces are crimped, bent or folded into connection with an insulation coating of the wire W.

A recess 14 is formed in the longitudinal middle of the bottom surface of the main portion 12. An intermediate portion of the front edge of the recess 14 is embossed out to form a locking protrusion 15. A locking step is formed at the rear end of the bottom surface of the main portion 12. The locking step is embossed to form a protrusion 17 that projects up to substantially the same height as the locking protrusion 15. A stabilizer 18 is formed at a position immediately before the protrusion 17 and projects farther out than the protrusion 17. The stabilizer 18 stabilizes the insertion of the male terminal fitting 10 and prevents an improper (e.g. upside-down) insertion.

The male housing 20 is made e.g. of a synthetic resin, and is comprised of a receptacle 21 and a terminal accommodating portion 22 that are coupled one after the other. The receptacle 21 is a wide rectangular tube with an open front for receiving a mating female connector. A lock (not shown) is provided on the ceiling surface of the receptacle 21 and is engageable with a lock arm of the female connector to hold the male connector connected with the female connector. The terminal accommodating portion 22 is configured for accommodating the male terminal fittings 10 as shown in FIG. 4.

Cavities 23 are arranged substantially side by side along the widthwise direction at upper and lower stages. The male terminal fittings 10 are insertable into the cavities from behind and along the inserting and withdrawing directions IWD. A lock 24 is provided at the bottom surface of each cavity 23 for locking the male terminal fitting 10. The housing 20 has a front wall 25 at the front of each cavity 23 to define front-end positions for the terminal fittings 10 in the cavities 23. A tab insertion hole 26 is formed in the front wall 25 for enabling insertion of the tab 11 of the male terminal fitting 10. A protrusion-insertion groove 27 is formed substantially in the widthwise center of the bottom surface of the cavity 23 for receiving the locking protrusion 15 and the protrusion 17 of the male terminal fitting 10. A stabilizer-insertion groove 28 is formed in a back part of the bottom surface of the cavity 23 for receiving the stabilizer 18. The protrusion-insertion groove 27 is formed continuously in the lock 24, as described later, whereas the front end of the stabilizer-insertion groove 28 is slightly behind the base end position of the lock 24. The stabilizer-insertion groove 28 is deeper than the protrusion-insertion groove 27.

A retainer mount hole 29 is formed in a substantially longitudinal middle portion of one outer surface of the terminal accommodating portion 22. The retainer mount hole 29 is open in a three-surface area including the bottom surface and the opposite side surfaces of the terminal accommodating portion 22. In other words, the retainer mount hole 29 is open in three directions. The retainer mount hole 29 has a depth to reach above and beyond the upper walls of the cavities 23 at the upper stage. Additionally, the retainer mount hole 29 divides the surrounding walls of the cavities 23 at the upper and lower stages into front and rear sections, thereby exposing the respective cavities 23 to the outside at their intermediate positions. The front edge of the retainer mount hole 29 is substantially straight along the vertical direction and substantially normal to the inserting and withdrawing directions IWD except its upper end, whereas the rear edge is inclined up towards the front at an acute angle to the inserting and withdrawing directions IWD.

Figure 8:
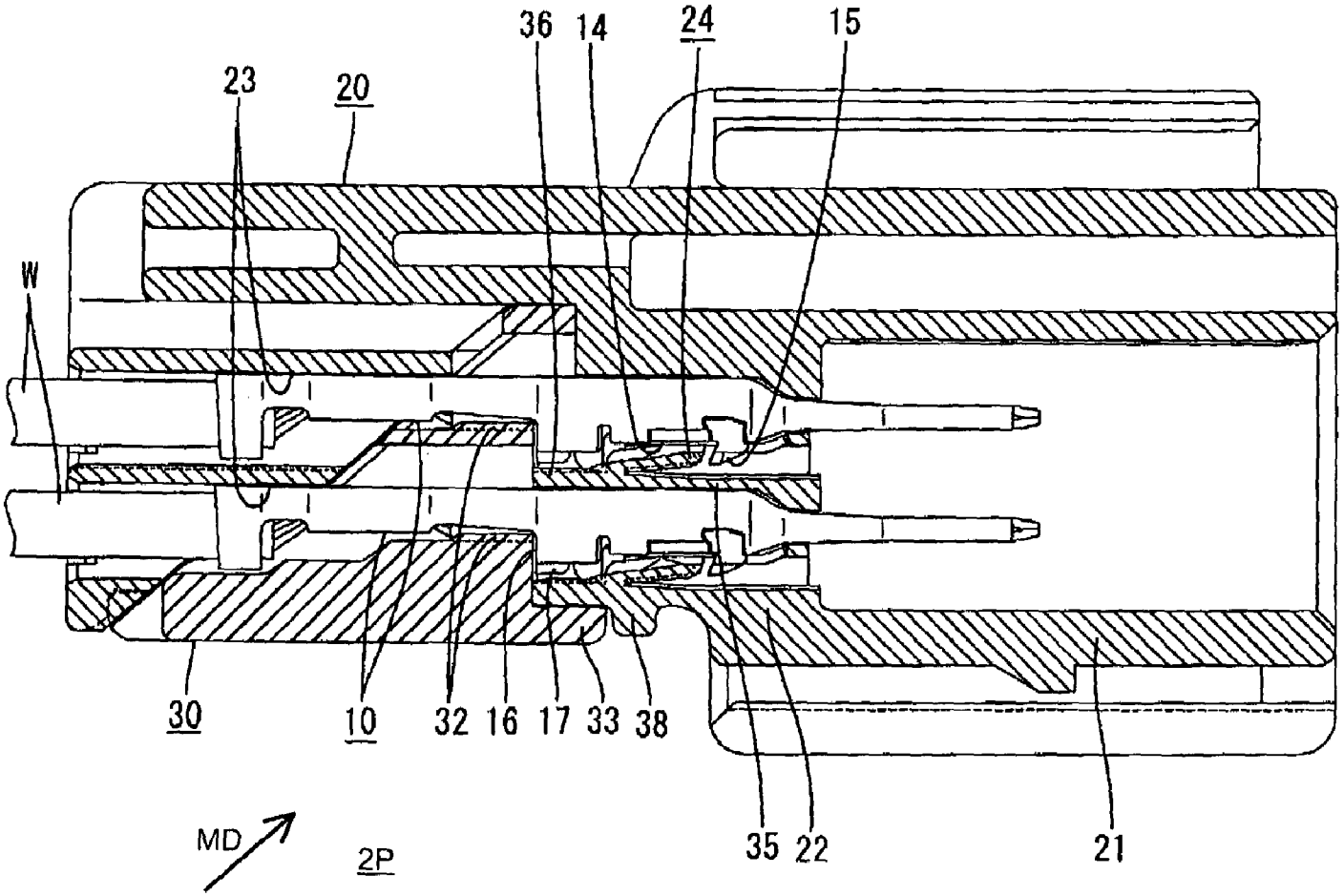
FIG. 8 is a section similar to FIG. 4, but showing a state where a retainer is pushed to a full locking position.

The retainer 30 is made e.g. of a synthetic resin and has terminal insertion holes 31 at positions corresponding to the cavities 23 for receiving the respective the male terminal fittings 10. Thus, the retainer 30 is substantially lattice-shaped. Fasteners 32 are defined at the lower edges of the respective terminal insertion holes 31 of the retainer 30. The fasteners 32 engage the locking steps 16 and the protrusions 17 of the male terminal fittings 10. The retainer 30 is movable along a mounting direction MD between a partial and full locking position 1P and 2P. During this movement, the retainer 30 is displaced in the mounting direction MD substantially along the rear edge of the retainer mount hole 29, and the mounting direction MD is oblique to the inserting and withdrawing directions IWD of the male terminal fittings 10. The terminal insertion holes 31 are retracted from the corresponding cavities 23 when the retainer 30 is in the partial locking position 1P to permit the insertion and withdrawal of the male terminal fittings 10 into and from the cavities 23 (see FIG. 4). However, the fasteners 32 enter the corresponding cavities 23 and engage the locking steps 16 and the protrusions 17 of the male terminal fittings 10 when the retainer 30 is in the full locking position 2P, thereby locking the male terminal fittings 10 (FIG. 8). A projection 33 is provided at the bottom end of the retainer 30 and projects forward substantially along the inserting and withdrawing directions IWD. The retainer 30 can be held selectively at the partial locking position 1P or the full locking position 2P in the male housing 20 by unillustrated holding means.

The retainer mount hole 29 divides the bottom wall 34 of each cavity 23 into a front section and a rear section. A lower part 35 is formed along about the front two-thirds of the front section of each cavity 23 and a raised part 36 is formed along about the rear one-third of the front section. The lower part 35 is slightly lower than the raised part 36. The lock 24 projects from a step between the lowered part 35 and the raised part 36. The lock 24 is inclined gradually up and in towards the front end and projects into the cavity 23. Portions of the lock 24 in the cavity 23 are pressed as the male terminal fitting 10 is inserted into the cavity 23. Thus, the lock 24 deforms resiliently down into a deformation space S. The locking protrusion 15 of the male terminal fitting 10 can enter a space before the lock 24. The lowered part 35 of the bottom wall 34 substantially faces the lock 24 from below with the deformation space S therebetween and engages a lower surface 39*a* of the lock 24 before the lock 24 is deformed beyond its resiliency limit. As a result, excessive deformation of the lock 24 is prevented. A mold removal hole 37 opens forward at a position in the front wall 25 of the cavity 23 below the tab insertion hole 26, and is formed by removing a mold for forming the frontal shape of the lock 24. The mold-removal hole 37 does not communicate with the tab insertion hole 26.

The protrusion-insertion groove 27 and the stabilizer-insertion groove 28 cause the raised part 36 of the bottom wall 34 to be thinner in substantially the widthwise center and at the back side of FIG. 4 than at the front side of FIG. 4. The bottom walls 34 of the cavities 23 at the upper stage partition the upper and lower cavities 23, and the bottom walls 34 of the cavities 23 at the lower stage serve as the bottom wall of the terminal accommodating portion 22. At least one catch preventing portion 38 projects down on the lower surfaces of the bottom walls 34 at the lower stage and is substantially adjacent to the projection 33 when the retainer 30 reaches the full locking position 2P to prevent the wire W or the like from getting caught by the projection 33.

Figure 3:
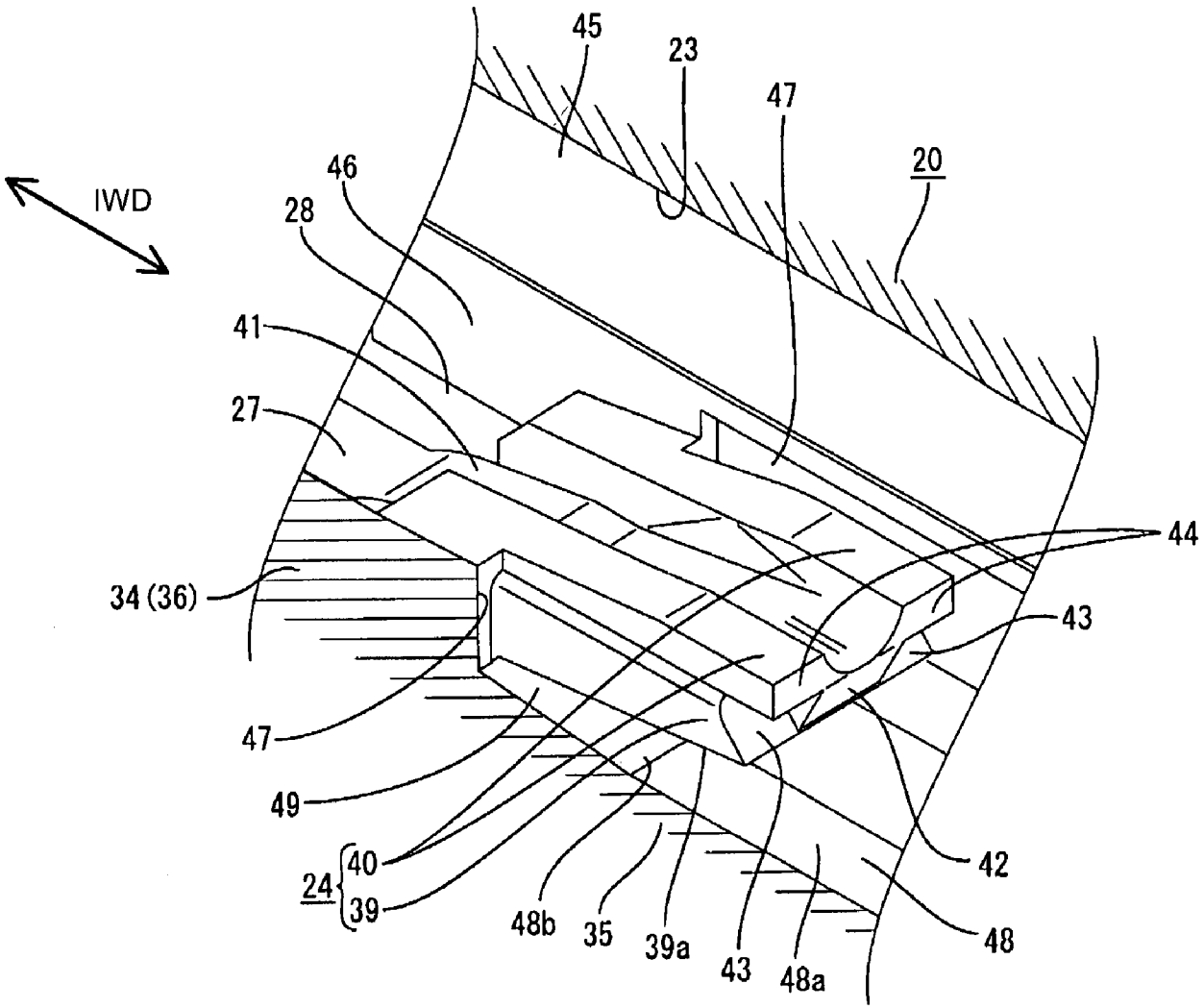
FIG. 3 is a partial perspective view partly in section showing the male housing.

As shown in FIG. 3, the lock 24 has a base 39 cantilevered forward from the step of the bottom wall 34, and a projection 40 projecting into the cavity 23 from the upper surface of the base 39. The upper surface of the base 39 is at substantially the same height as the bottom surface of the cavity 23, and a projecting distance of the projection 40 into the cavity 23 is substantially equal to the depth of the recess 14 of the male terminal fitting 10. The upper surface of the base 30 is substantially horizontal and extends substantially along the inserting and withdrawing directions IWD. However, a lower surface 39*a* of the base 30 slopes up towards the front and intersects the inserting and withdrawing directions IWD. Thus, the base 39 is thicker towards the step than towards its leading-end. An escaping slanted surface 39*b* is formed at the front end of the lower surface 39*a* of the base 39 (FIG. 5(A)) and has a steeper inclination to the inserting and withdrawing directions IWD than the adjacent part of the lower surface 39*a*. On the other hand, a rear part of the upper surface of the projection 40 slopes up to the front. However, a front part of the upper surface of the projection 40 is substantially horizontal along the inserting and withdrawing directions IWD. Thus, a rear part of the projection 40 is gradually thicker toward the front, whereas a front part has a substantially constant thickness.

The protrusion-insertion groove 27 recesses substantially the entire upper surface of the lock 24 in substantially the widthwise center. Portions of the protrusion-insertion groove 27 on the rear end of the lock 24 gradually narrow towards the front, while portions of the protrusion-insertion groove 27 near the front end of the lock 24 have an arcuate cross section. The protrusion-insertion groove 27 divides the projection 40 into left and right sections along the widthwise direction over substantially the entire length, whereas the base 39 has its rear part cut obliquely to a specified depth. The bottom surface of the protrusion-insertion groove 27 in the lock 24 has an upward inclination towards the front except for a substantially horizontal surface at the front end. The inclination is more moderate than the escaping slanted surface 39*b*, but is slightly steeper than the lower surface 39*a* of the base 39. A bulge 41 bulges up on the bottom surface of the protrusion-insertion groove 27 at a portion of the lock 24 coupled to the bottom wall 34.

A locking surface 42 slopes up towards the front at substantially the widthwise middle of the front surface of the base 39. The locking surface 42 is engageable with the rear end surface of the locking protrusion 15 of the male terminal fitting 10. The locking surface 42 has an inclination to extend substantially along the rear end surface of the locking protrusion 15. Two maneuverable recesses 43 are formed in opposite widthwise side positions adjacent to the locking surface 42 along widthwise direction of the front surface of the base 39 and are maneuverable by a jig 50 inserted from the front for deforming the lock 24. The maneuverable recesses 43 are exposed to the outside in the front at positions displaced along widthwise direction from the locking protrusion 15 even with the male terminal fitting 10 locked by the lock 24. The jig 50 has a grip 51 that can be held by an operator. The front end of the jig 50 is forked to form two operating portions 52 that are insertable into the respective maneuverable recesses 43 (see FIG. 9). The upper surfaces of the maneuverable recesses 43 are substantially horizontal, whereas the bottom surfaces are inclined up and back. On the other hand, the projection 40 has a front locking surface 44 that is substantially straight along a vertical direction normal to the inserting and withdrawing directions IWD and is substantially continuous with the locking surface 42. The locking surface 44 is engageable with the front end surface of the recess 14 of the male terminal fitting 10.

Figure 2:
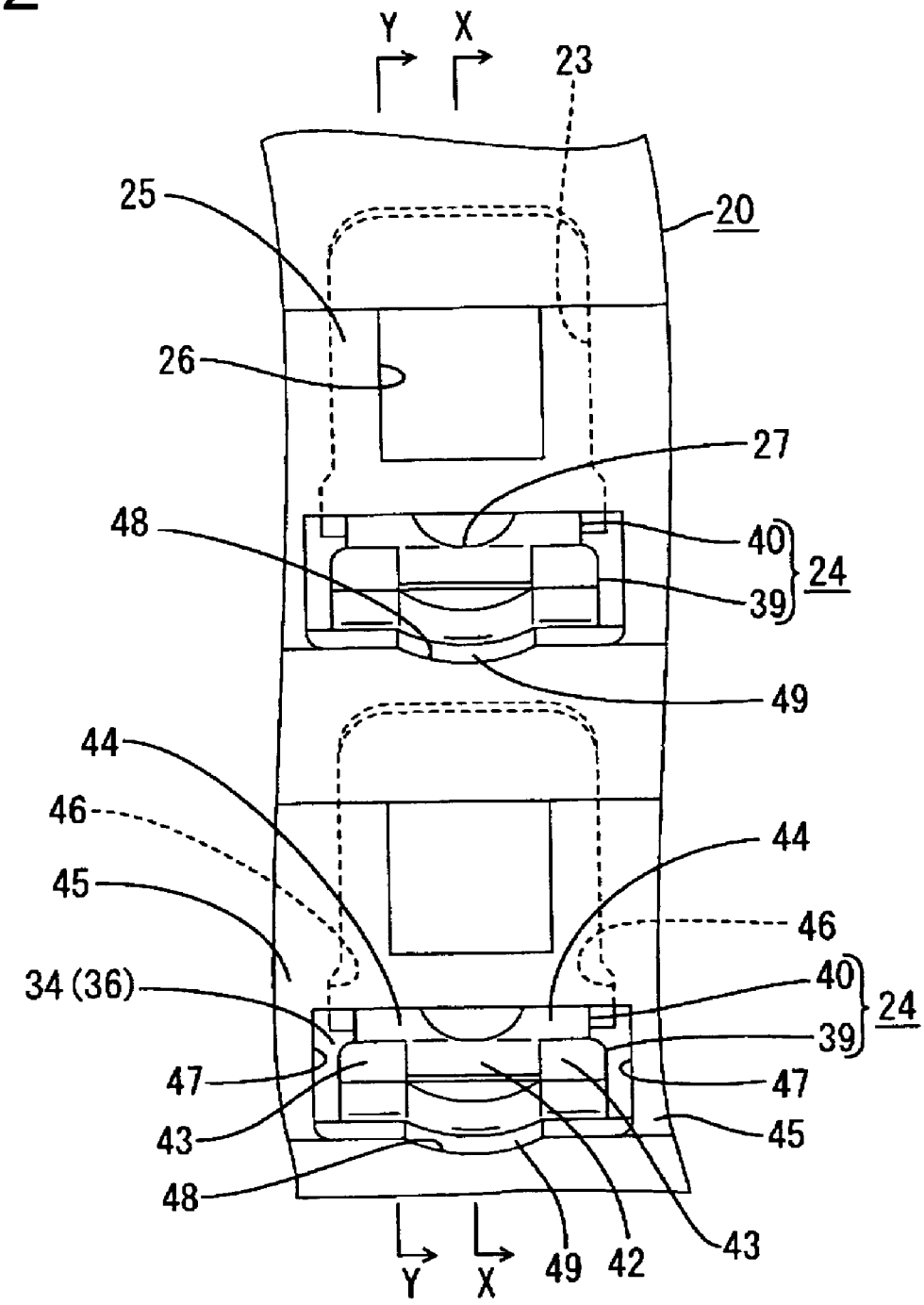
FIG. 2 is an enlarged front view of a male housing.

As shown in FIG. 2, the base 39 of the lock 24 is wider than the projection 40. More specifically, the base 39 is at least as wide as the cavity 23, whereas the projection 40 is slightly narrower than the cavity 23. Grooves 46, 47 are formed in opposite sidewalls 45 of the cavity 23 so that the lock 24 can have this shape. The grooves 46, 47 have open front and rear ends and are formed by removing pins of a forming molding to the front and back sides of the female housing 20. Accordingly, the pins of the mold can be made thicker by as much as the depth of the grooves 46, 47, thereby ensuring sufficient strength for the pins. Conversely, the base 39 and the projection 40 can be wider by as much as the depths of the grooves 46, 47.

Figure 5A:
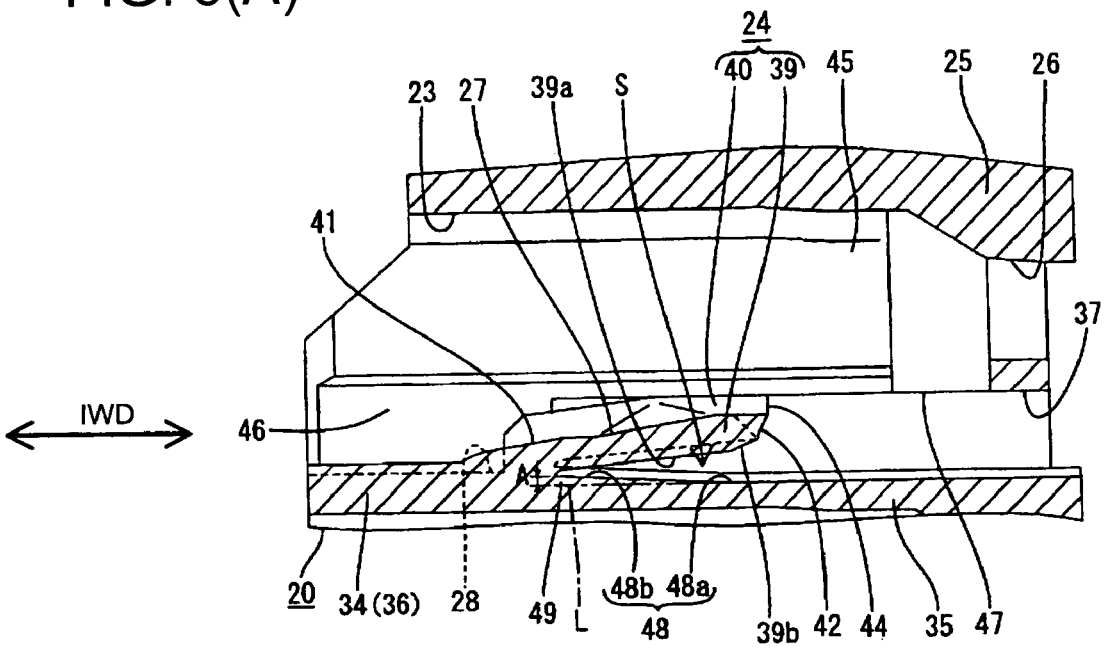
FIGS. 5(A) and 5(B) are an enlarged section along 4—4 of FIG. 2 and an enlarged section along 5(B)—5(B) of FIG. 2 showing a cavity at an upper stage.
Figure 5B:
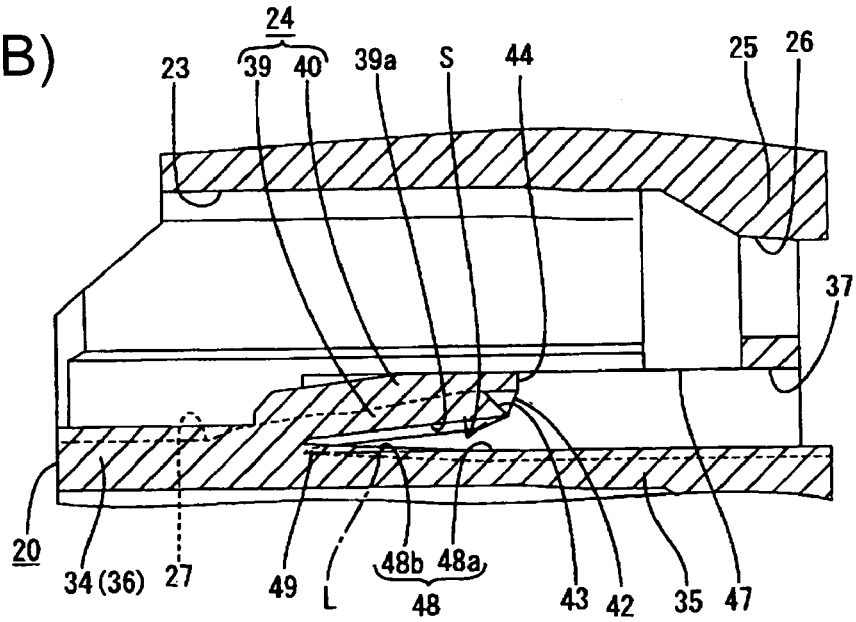

The lowered part 35 of the bottom wall 34 faces the lock 24 with the deformation space S therebetween. More particularly, an upper surface 48 of the lowered part 35, as shown in FIG. 2, substantially conforms with the shape of the lower surface 39*a* of the lock 24 with respect to the widthwise direction. Specifically, a substantially widthwise center of the upper surface 48 is recessed arcuately and portions at the opposite widthwise sides of this recess are substantially horizontal. On the other hand, a substantially horizontal surface 48*a* extends along about the front two-thirds of the upper surface 48 of the lowered part 35 and is substantially parallel to the inserting and withdrawing directions IWD. However, a slanted surface 48*b* extends along less than about half of the rear of the lowered part 35, most preferably about a rear one-third, and slopes up towards the back, as shown in FIG. 5. Thus, the lowered part 35 is gradually thicker towards the base end of the lock 24. Additionally, an inclined bulge 49 bulges up towards the lock 24 from a straight phantom line L extending substantially along the horizontal surface 48*a* at the front.

The bulge 49 has a substantially triangular or trapezoidal cross section and has its rear end coupled to the base end of the lock 24. A bulging distance from the phantom line L takes a maximum value A at this coupled portion. The bulge 49 bulges up to substantially reach the lower surface 39*a* when the lock 24 is deformed maximally and assumes the maximally deformed position MDP of FIG. 9. Thus, a maximum bulging distance is obtained by forming the bulge 49 to take advantage of a dead space below the lock 24. The bulge 49 is wider than the base 39 of the lock 24 and the opposite sides thereof bulge into the grooves 47 to be coupled to the opposite side walls 45 of the cavity 23.

The bulge 49 enables a path between the lock 24 and the lowered portion 35 to be thicker by as much as the maximum value A of the bulging distance of the bulge 49 out of flowing paths of molten resin being filled into a forming mold, as compared to a case where the lowered part 35 extends horizontally along the phantom line L. Fluidity of the resin is improved further due to the inclination of the bulge 49.

The male housing 20 is formed with a mold whose parts are movable forward, backward and downward to open. The mold is closed and a molten resin is filled inside. The resin fills the inside through a gate at a specified position of the forming mold. At this time, there is a possibility that the fluidity is deteriorated at thin parts of the male housing 20, such as the flowing paths between the lowered parts 35 of the bottom walls 34 and the locks 24. Further, the bottom walls 34 are divided into front and rear sections by the retainer mount hole 29 in the male housing 20. Thus, the resin flowing paths for the lowered parts 35 and the locks 24 from the rear sides of the bottom walls 34 are cut, and the fluidity of the resin may deteriorate. The fluidity of the resin material also may deteriorate by arcuately recessing the widthwise middle portions of the lowered parts 35 in conformity with the shape of the lower surfaces 39*a* of the locking portions 24.

However, in this embodiment, the bulges 49 are formed near the coupled portions of the lowered parts 35 to the locks 24 and the resin flowing paths between the lowered parts 35 and the locks 24 are enlarged by the maximum value A of the bulging distance. The fluidity of the resin is improved at these paths. Thus, the resin can flow more easily to the positions where the locks 24 and the lowered parts 35 are planned to be formed. The formed male housing 20 can be opened when the resin has solidified.

Figure 6A:
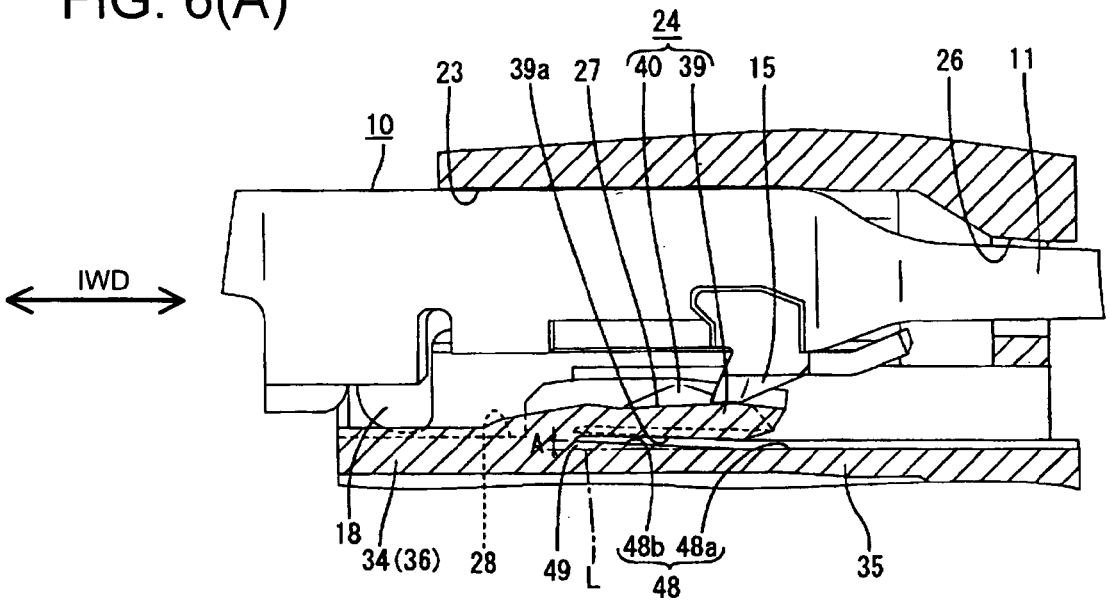
FIGS. 6(A) and 6(B) are sections similar to FIGS. 5(A) and 5(B), but showing an intermediate stage of the insertion of the male terminal fitting.
Figure 6B:
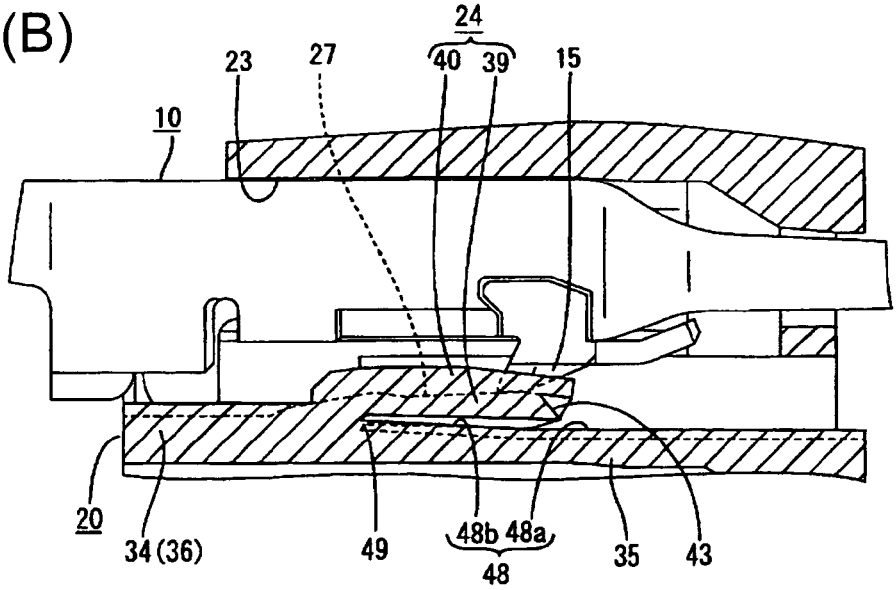
Figure 7:
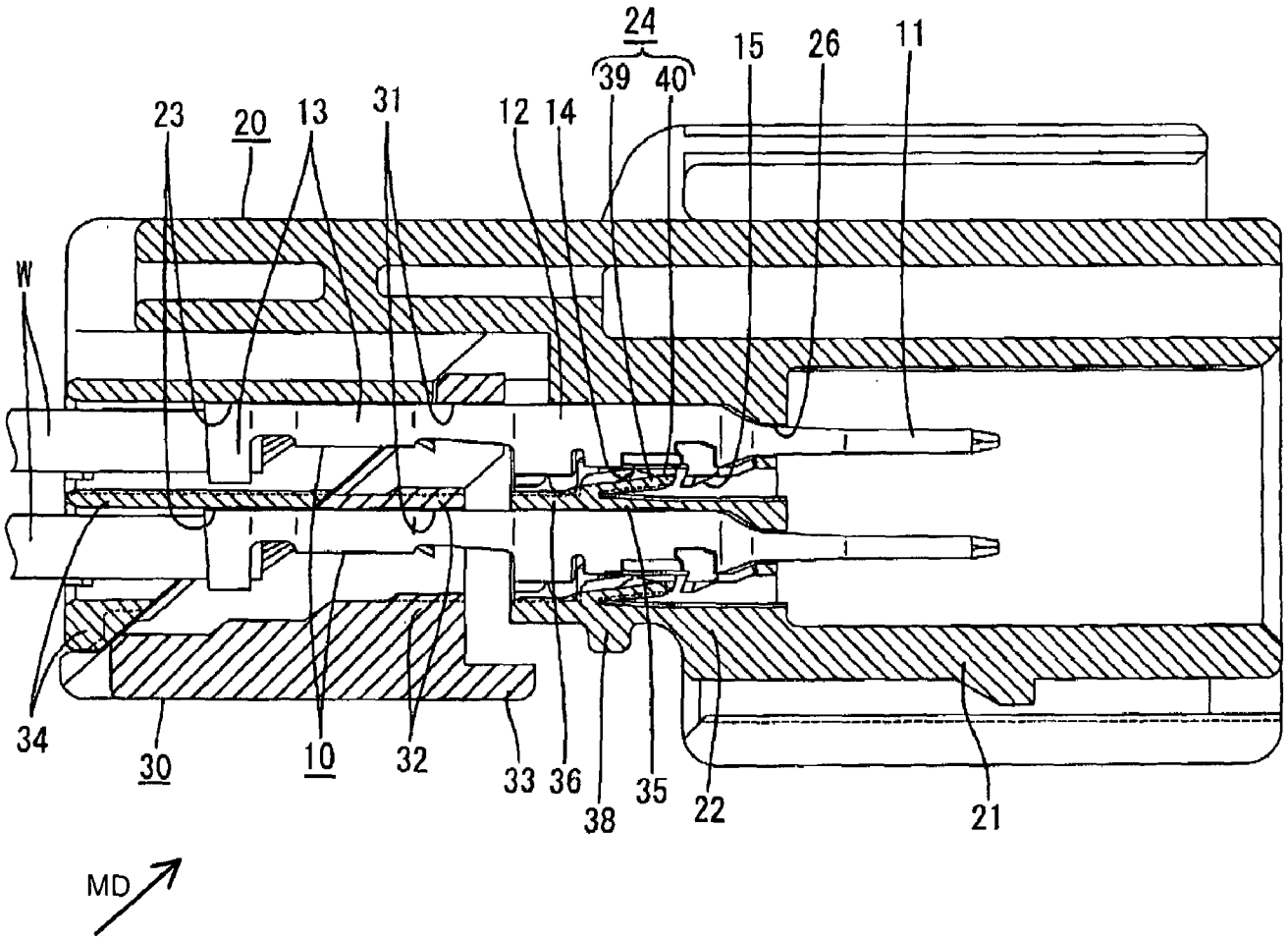
FIG. 7 is a section similar to FIG. 4, but showing a state where locks lock the male terminal fittings.

The retainer 30 is mounted in the mounting direction MD into the retainer mount hole 29 of the male housing 20 and is held at the partial locking position 1P as shown in FIG. 4. The male terminal fitting 10 connected with the end of the wire W then is inserted. More particularly, the locking protrusion 15 and the protrusion 17 are inserted into the protrusion-insertion groove 27 and the stabilizer 18 is inserted into the stabilizer-insertion groove 28 to guide the insertion of the male terminal fitting 10. The locking protrusion 15 pushes the lock 24 down as shown in FIGS. 6(A) and 6(B) when the male terminal fitting 10 reaches a specified depth. The locking protrusion 15 moves beyond the lock 24 when the male terminal fitting 10 is inserted to the proper depth in the cavity 23, and the lock 24 is restored resiliently to enter the recess 14 and engage the male terminal fitting 10, as shown in FIG. 7. At this time, the locking surface 42 of the lock 24 substantially engages the rear end surface of the locking protrusion 15 and the locking surface 44 thereof engages the front end surface of the recess 14.

The retainer 30 is pushed in the moving direction MD to the full locking position 2P after all of the male terminal fittings 10 are inserted. The retainer 30 is pushed obliquely up in the moving direction MD along the rear edge of the retainer mount hole 29 to reach the full locking position 2P. Thus, the fasteners 32 enter the corresponding cavities 23 to engage the locking steps 16 and/or the protrusions 17 (only the locking steps 16 at the upper stage) of the male terminal fittings 10 as shown in FIG. 8. As a result, the male terminal fittings 10 are locked doubly. At this time, the projection 33 of the retainer 30 is near the catch preventing portion 38, and it is more difficult for the projection 33 to get caught by external wires W. As a result, the retainer 30 is unlikely to be moved inadvertently toward the partial locking position 1P.

Figure 9A:
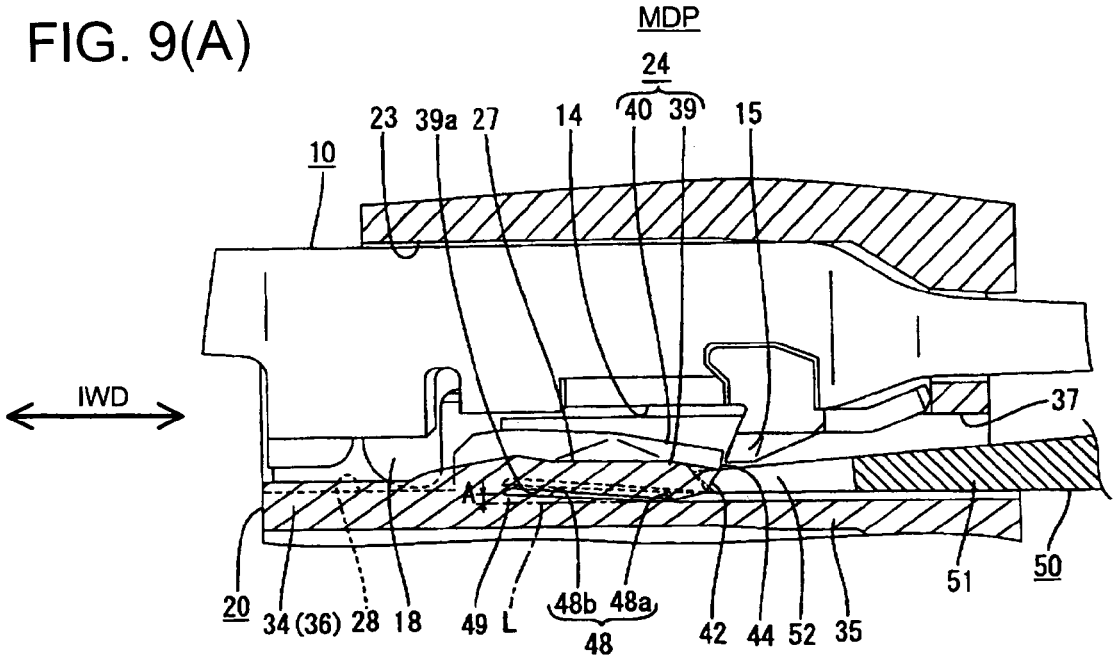
FIGS. 9(A) and 9(B) are sections similar to FIGS. 5(A) and 5(B), but showing a state where the lock is deformed by a jig.
Figure 9B:
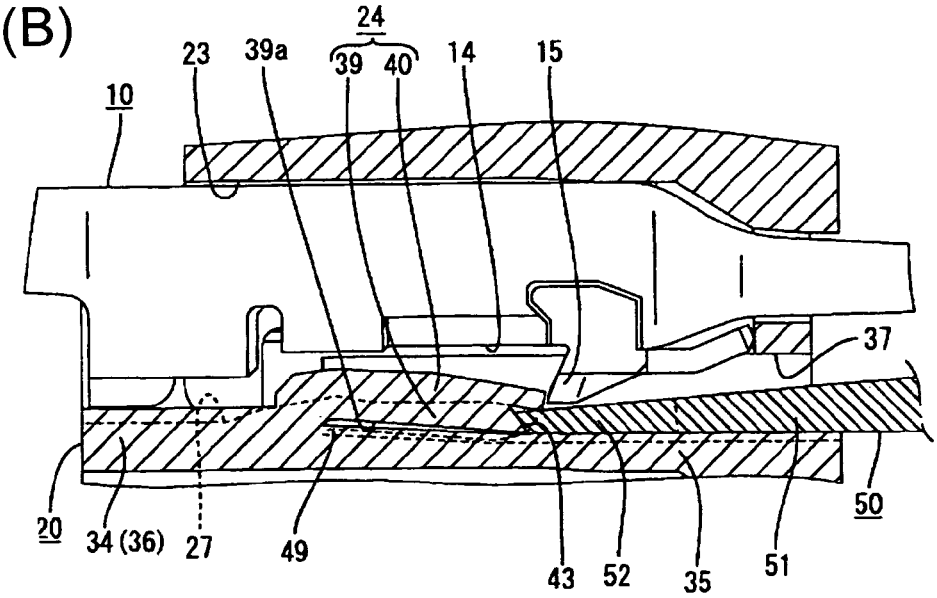
Figure 10:
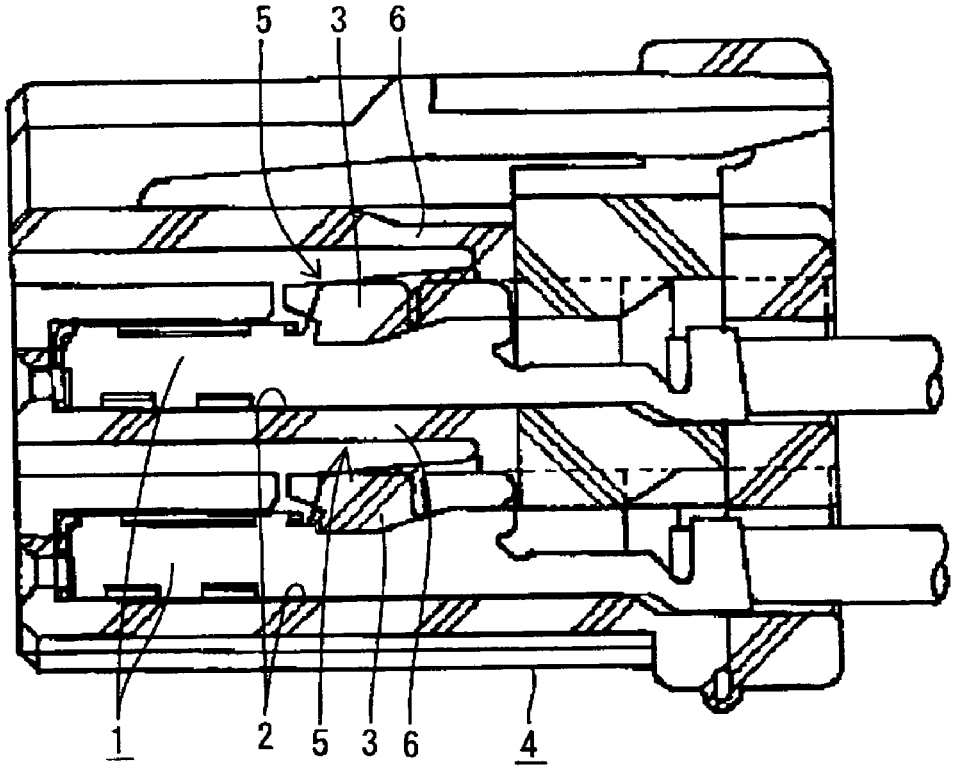
FIG. 10 PRIOR ART
FIG. 10 is a section of a prior art connector.

The male terminal fitting 10 may have to be detached for maintenance or other reason. In this case, the retainer 30 is moved to the partial locking position 1P and the jig 50 is used to cancel the locked state of the lock 24. The jig 50 is inserted into the mold-removal hole 37 and both operating portions 52 are inserted into the maneuverable recesses 43 of the lock 24. The jig 50 then is pivoted up and the lock 24 is deformed down and away from the terminal fitting 10. The male terminal fitting 10 is completely freed from its locked state when the lock 24 is deformed maximally, as shown in FIG. 9. The male terminal fitting 10 is pulled out of the cavity 23 by pulling the wire W backward while holding the lock 24 in this state.

As described above, the lowered parts 35 of the bottom walls 34 facing the locks 24 with the deformation spaces S substantially therebetween are provided at their portions coupled to or near the base ends of the locks 24 with the bulges 49 bulging towards the locks 24. Thus, the molten resin can flow more easily to the positions in the forming mold where the locks 24 and the lowered parts 35 are to be formed. As a result, molding errors can be made more difficult to occur in the male housing 20. Further, the bulges 49 take advantage of dead spaces between the locks 24 and the lowered parts 35, and do not enlarge the male connector.

Each bulge 49 bulges up to the position proximate to the position reached by the lower surface 39*a* of the corresponding lock 24 facing the deformation space S when the lock 24 is deformed maximally. Thus, the bulge 49 utilizes the dead space and the fluidity of the resin is improved.

Each bulge 49 is inclined so that the bulging distance gradually increases towards the end of the lock 24 and takes its maximum value A at or near the coupled portion of the lock 24. Thus, the fluidity of the resin material is improved as compared to a case where the bulge 49 has a stepped shape.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The shape and dimensions of the bulges can be changed. For example, the bulges may have a stepped or rounded shape. Further, the bulging distance of the bulges may be smaller than the one where the bulges are at the positions proximate to the positions reached by the lower surfaces of the locks when the locks are maximally resiliently deformed. The bulges may be formed, for example, only at substantially the widthwise middles of the thin lowered parts of the bottom walls.

The shape of the locks can be changed. For example, the invention is also applicable to locks whose bases extend substantially horizontally or are supported at both ends.

Although the male connector accommodating the male terminal fittings is illustrated in the foregoing embodiment, the invention is also applicable to female connectors accommodating female terminal fittings.

What is claimed is:

1. A connector comprising a housing made of resin and having opposite front and rear ends, the housing having at least one cavity extending from the rear end towards the front end for receiving a terminal fitting, a deformation space substantially adjacent the cavity and being defined partly by a wall facing towards the cavity, at least one lock having a base end unitary with the wall and a projecting end projecting angularly from the wall and partly into the cavity so that the deformation space is defined between the lock and the wall, the lock being temporarily deformable into the deformation space in response to forces exerted by inserting the terminal fitting into the cavity and being resiliently restorable to lock the terminal fitting when the terminal fitting reaches a proper depth, the wall including a bulge projecting towards the lock and into the deformation space from a location substantially adjacent the base of the lock, the bulge being inclined so that a bulging distance thereof gradually increases along a substantial length of the lock and towards the base end of the lock for ensuring a structural continuity of the wall, whereby the inclination of the bulge uses a of dead space between the wall and lock.

2. The connector of claim 1, wherein the bulge is wider than a portion of the lock in the deformation space.

3. The connector of claim 1, wherein a portion the lock closer to the deformation space is wider than a portion of the lock projecting into the cavity.

4. The connector of claim 3, wherein the portion of the lock closer to the deformation space has a width substantially equal to or slightly wider than the cavity, and wherein the portion of the lock projecting into the cavity is slightly narrower than the cavity.

5. The connector of claim 1, wherein grooves are formed in opposite side walls of the cavity, the grooves having open front ends.

6. The connector of claim 5, wherein opposite sides of the bulge bulge laterally into the grooves and connect to the sidewalls of the cavity.

7. The connector of claim 1 wherein the lock is cantilevered forward from the base end.

8. The connector of claim 7, wherein a portion of the wall forward of the bulge is configured for engaging a surface of the lock facing into the deformation space before the lock is deformed beyond its resiliency limit.

* * * * *